United States Patent [19]

Boucard Jean

[11] Patent Number: 4,993,322

[45] Date of Patent: Feb. 19, 1991

[54] DEVICE FOR SELECTION AND TRIGGERING OF FIRING CIRCUIT

[75] Inventor: Boucard Jean, Boulogne, France

[73] Assignee: Thomson-Brandt Armements, Boulogne Billancourt, France

[21] Appl. No.: 234,021

[22] Filed: Aug. 18, 1988

[30] Foreign Application Priority Data

Aug. 14, 1987 [FR] France ..... 87 11582

[51] Int. Cl.[5] ..... F23Q 3/00

[52] U.S. Cl. ..... 102/218; 102/270

[58] Field of Search ..... 102/206, 217, 218, 220, 102/270

[56] References Cited

U.S. PATENT DOCUMENTS

| | | | |
|---|---|---|---|
| 821,883 | 5/1906 | DuPont | 102/206 |
| 1,959,479 | 5/1934 | Kielczewski | 102/206 |
| 3,312,869 | 4/1967 | Werner | 102/217 |
| 3,661,088 | 5/1972 | Hunn et al. | 102/215 |
| 3,675,578 | 7/1972 | Douglas et al. | 102/206 |
| 3,877,376 | 4/1975 | Kupelian | 102/492 |
| 3,955,505 | 5/1976 | Johnston | 102/206 |
| 4,297,947 | 11/1981 | Jones et al. | 102/206 |

FOREIGN PATENT DOCUMENTS

| | | | |
|---|---|---|---|
| 163927 | 1/1954 | Australia | 102/217 |
| 479272 | 12/1951 | Canada | 102/206 |

*Primary Examiner*—Charles T. Jordan
*Assistant Examiner*—Stephen Johnson
*Attorney, Agent, or Firm*—Roland Plottel

[57] ABSTRACT

Disclosed is a device enabling the selective, simultaneous triggering of high energy detonators, using no sensitive pyrotechnical device, such as exploding wire detonators or slappers. The device comprises, for each of the detonators, an electrical triggering chain comprising a capacitor used to deliver energy sufficient to trigger each of the detonators. It comprises a single energy source generating a pulse and a single switch to apply the pulse to each electrical triggering chain. Means to inactivate the corresponding chain are applied before the commutation of the switch so as to make those detonators that are not to be triggered inoperative.

13 Claims, 2 Drawing Sheets

DEVICE FOR SELECTION AND TRIGGERING OF FIRING CIRCUIT

BACKGROUND OF THE INVENTION

1. Field of the Invention

The invention concerns the selective and simultaneous or sequential triggering of high-energy detonators, such as exploding wire detonators or slappers using no sensitive pyrotechnical composition.

2. Description of the Prior Art

There is a felt need, in the field of military charges, to modulate the firing of the charge according to the target, and to do so at the last moment, depending on the position, nature and speed of motion of the target to be reached. This can be obtained by placing several detonators beforehand in the explosive charge, and by selecting, at the last moment, the detonator or detonators to be triggered according to the result to be obtained. This choice must be made when the parameters of the terminal trajectories are known, namely at the instant very shortly before the command to explode the charge.

Furthermore, it is difficult to obtain the almost simultaneous triggering of several detonators.

The value of exploding wire detonators or slappers which do not necessitate the interruption of the pyrotechnical chain in the priming of explosive charges, is known. Furthermore, there are known devices for the commutation of the useful energy in this type of detonator. These are so-called spark-gaps controlled by a high-voltage electrical pulse. The operation of these devices consists in discharging a high-voltage charged capacitor by a control pulse given by a low-voltage/high-voltage pulse transformer. When several priming points are needed, the method consists in using several of these identical circuits. These different points are used, as described earlier, to modulate the firing of the explosive charge.

This method enables the triggering of the detonators according to a given sequence but has certain drawbacks, namely:

the need to use several spark-gaps, one for each point, thus leading to major cost increases in cost and lower dependability;

the difficult of obtaining the precise synchronization of the operation of the spark-gaps to obtain the desired simultaneity in operation with a time difference, called "gitter", of some $10^{-7}$ between the various triggering moments;

the storage of a sufficient quantity of energy for the triggering of each detonator.

The aim of the invention is to cope with these various drawbacks by proposing a selective firing circuit with very fast, simultaneous and selective triggering of a determined number of detonators.

SUMMARY OF THE INVENTION

Consequently, the object of the invention is a device for the selection and selective triggering of detonators comprising, for each detonator, an electrical triggering chain to communicate a firing electrical pulse to each detonator, said device comprising a single energy source which generates said pulse, a single switch to apply said pulse to said electrical triggering chains and means to inactivate the corresponding chain before the switch is commutated, so as to make those detonators which are not to be triggered inoperative, the device comprising, in each triggering chain, a capacitor used to deliver, to each detonator, energy sufficient for it to be triggered.

BRIEF DESCRIPTION OF THE DRAWINGS

The invention and its characteristics will be better understood from the following description and the appended figures, of which.

DESCRIPTION OF THE PREFERRED EMBODIMENTS

Figure 1:
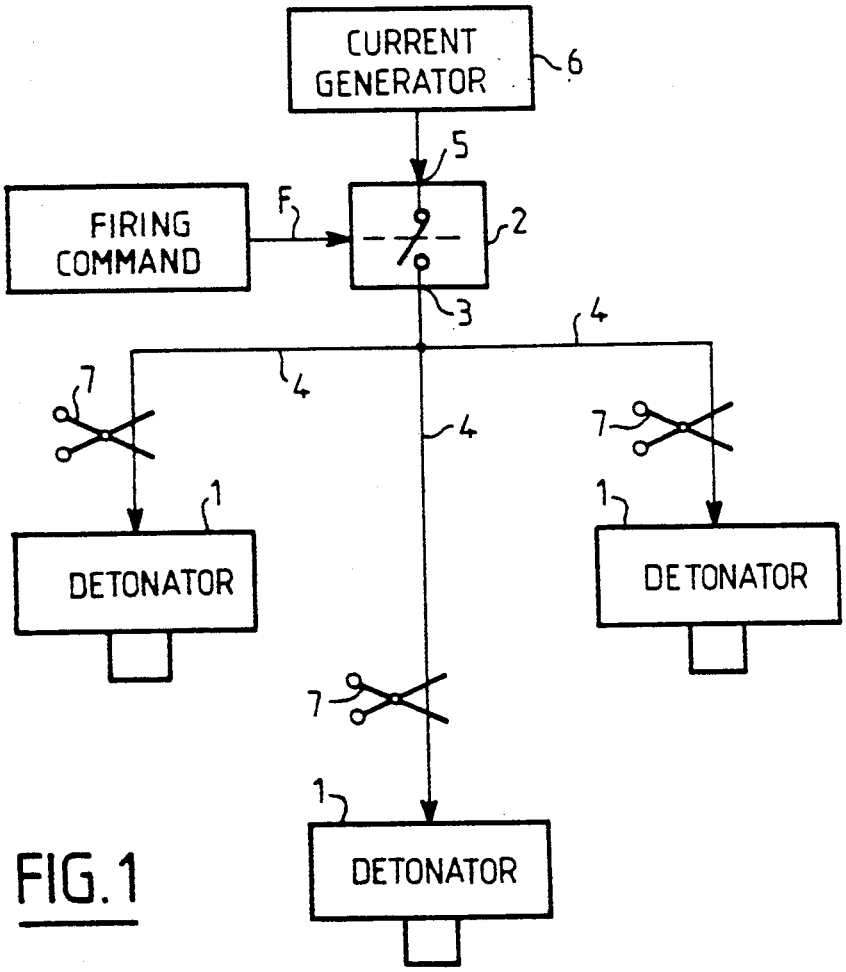
FIG. 1 is a diagram relating to the principle of operation of the device according to the invention.

Referring to FIG. 1, the device according to the invention can be applied to several detonators 1, the number of which is not limited to three. These detonators are of the slapper type and work as follows. They use a metallic cap placed on a flat conducting electrical cable with very low self-inductance. A current pulse which is brief but has considerable field strength, of several thousands of amperes, flows through the conductor and ejects the cap at high speed in a direction perpendicular to the conductor. In this direction are placed one or more pyrotechnical compositions capable of being initiated by the impact of the cap and capable of initiating a pyrotechnical device or an explosive charge. With this type of detonator, no prior interruption of the pyrotechnical chain is required.

According to the invention, a single energy source 6 and a single switch 2 are used.

The selection of the detonator or detonators that are to be made to work at the same instant is done through inactivating means 7, which are symbolized by pairs of scissors and are each placed on a firing chain 4, downstream of the capacitor and upstream of the detonator to be inhibited. The working principle of the device, for the operator, consists in making a prior selection of the detonator or detonators that he wishes to put into operation depending on the circumstances of the moment. For this purpose, he triggers the firing chain inactivating means 7 corresponding to the detonators that should not be put into operation, to cause sufficent breakdown in the corresponding transmission chains 4.

Then, at the desired instant, he sends the firing command signal F to close the interrupter 2 which is open at normal times. The pulse produced by the current generator 6 reaches the previously selected detonators at the same instant, and these detonators act simultaneously on the explosive charge.

Figure 2:
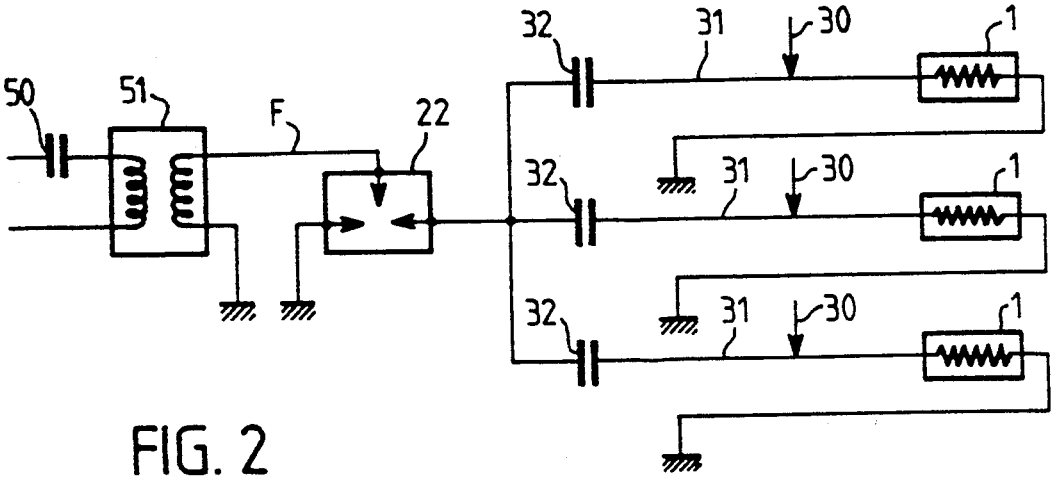
FIG. 2 is a diagram of a device according to the invention, with mechanical inactivating means.

FIG. 2 shows the inactivating means in the form of strikers symbolized by arrows 30. These strikers may be of the mechanical impact or pyrotechnical priming type or they may be of the mechanical type but controlled pyrotechnically, for example by micro-piston or by a micro-striker. Each striker is applied to a firing chain 31 folded back on itself, between a charged capacitor 32 and the detonator 1 with the aim of short-circuiting it.

The switch and the firing signal F generator can be formed by a discharger 22 controlled by a very high voltage electrical pulse F. A second approach consists in the use of a dielectric perforator controlled pyrotechnically. The pulse is given by a capacitor 50 which gets discharged through a low voltage/high voltage transformer 51.

A fast control pyrotechnical perforation enables local deterioration of the line sufficient to short-circuit the line and prevent the propagation of energy to the detonator. The perforator used may have be very small sized and may consume little current. Other inactivating devices are considered.

Figure 3:
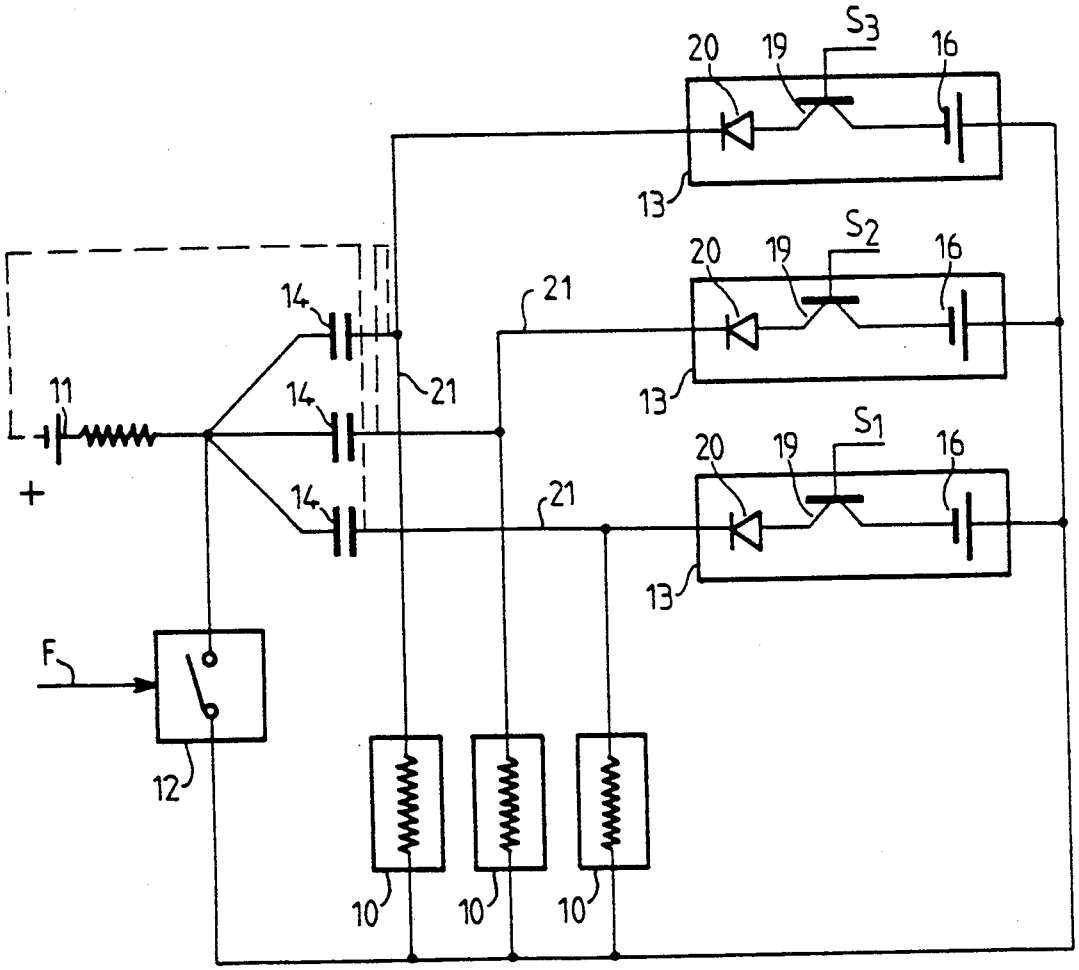
FIG. 3 is an electrical diagram of an embodiment of the device according to the invention, with electrical means for inactivating the firing chains.

FIG. 3 proposes an electrical diagram of the invention, the detonators being marked 10, the current generator being symbolized by the current source 11 and the three capacitors being marked 14. These capacitors 14 are placed on a triggering chain 21 downstream of a switch 12 and upstream of inactivating means 13 and detonators 10. There are also selection signals $S_1$, $S_2$, $S_3$ to select the inactivating means 13. The current source 11 is applied to the capacitors 14 and keeps them charged. Since the switch 12 is connected between the output of the capacitors 14 and the output of the detonators 10, the capacitors get discharged when the switch is closed giving sufficient and identical energy to each detonator, and thus make the detonators 10 work.

The inactivating means 13 may each comprise a current source 16 and a transistor 19 controlled by one of the selection signals and connected to the output of the control source 16, to apply, through a diode 20, a sufficient quantity of current to the firing chain 21 to make it inoperative by melting.

What is claimed is:

1. A device for selection and selective triggering of detonator comprising, for each detonator of said detonators (10), an electrical triggering chain (14,21) to communicate a firing electrical pulse to each said detonator, a single energy source (11) for said triggering chains, a single switch (12) to apply said pulses in said electrical triggering chains (14) and means for inactivating a chain of said triggering chains before the switch (12) is commutated so as to make those detonators which are not to be triggered inoperative, each said triggering chain having a capacitor (14) used to deliver, to each operative detonator of said detonators said pulse with energy sufficient for each said operative detonator to be triggered.

2. A device according to claim 1 wherein the capacitors are placed downstream of the switch and upstream of the inactivating means and the detonators.

3. A device according to claim 1 wherein the energy delivered to each of said detonators by each of said capacitors is identical.

4. A device according to claim 1 wherein the detonators are slappers.

5. A device according to claim 1 wherein the inactivating means are means for melting a corresponding chain of said triggering chains.

6. A device according to claim 1 wherein the inactivating means are of a mechanical impact type to short-circuit a corresponding chain of said triggering chains.

7. A device according to one of the claim 1 wherein the switch is a spark-gap controlled by a high voltage electrical pulse.

8. A device according to claim 2 wherein the energy delivered to each of said detonators by each of said capacitors is identical.

9. A device according to claim 2 wherein the inactivating means are means for melting a corresponding chain of said triggering chains.

10. A circuit for triggering a plurality of detonators comprising, a plurality of capacitors, one for each detonator to be triggered, and connectable to discharge through each of said detonators to be triggered, a single current source means connected to said capacitors for charging said capacitors with sufficient power so that when any of said capacitors discharges through its corresponding detonator, said detonator is triggered, a single switch means interconnected with said plurality of capacitors and detonators for, when operated, discharging said capacitors through said detonators, and inactivating means interconnected with said capacitors and detonators for inactivating selected capacitors of said plurality of capacitors from discharging through said detonators.

11. A circuit according to claim 10 wherein said single source and said capacitors provide for each of said discharges a field strength of several thousand amperes flowing through each of said detonators.

12. A circuit according to claim 11 wherein said capacitors operated by said single switch discharge simultaneously.

13. A circuit for simultaneously triggering a plurality of detonators comprising a plurality of capacitors, each connectable in series to one detonator, a plurality of inactivating circuits, each connected in parallel with a different capacitor, and said plurality of inactivating circuits used for selectively short-circuiting the capacitor to which it is connected, a single power source connection connected in series with said plurality of capacitor-detector series connections, and a single switch connected in series with said plurality of capacitor-detector series connections.

* * * * *